US006773328B2

(12) United States Patent
Tiefel et al.

(10) Patent No.: US 6,773,328 B2
(45) Date of Patent: Aug. 10, 2004

(54) ELECTRIC TOY TOP DEVICE WITH FINGER SUPPORTED CHARGER AND ITS ASSOCIATED METHOD OF OPERATION

(76) Inventors: Simeon E. Tiefel, 5852 NE. 197th St., Kenmore, WA (US) 98028; Webb T. Nelson, 19180 144th Ave. NE., Woodinville, WA (US) 98072

( * ) Notice: Subject to any disclaimer, the term of this patent is extended or adjusted under 35 U.S.C. 154(b) by 0 days.

(21) Appl. No.: 10/417,601

(22) Filed: Apr. 18, 2003

(65) Prior Publication Data

US 2004/0077253 A1 Apr. 22, 2004

Related U.S. Application Data

(63) Continuation-in-part of application No. 10/243,813, filed on Sep. 16, 2002, now Pat. No. 6,685,531.

(51) Int. Cl.[7] ..... A63H 29/18
(52) U.S. Cl. ..... 446/459
(58) Field of Search ..... 446/233, 256, 446/259, 264, 266, 131, 132; 273/147

(56) References Cited

U.S. PATENT DOCUMENTS 3,628,285 A 12/1971 Murakami ..... 46/243
4,200,283 A * 4/1980 Andrews et al. ..... 273/108
4,575,346 A * 3/1986 Ogawa ..... 446/259
5,024,625 A * 6/1991 MacCarthy ..... 446/259
6,089,946 A * 7/2000 Yang ..... 446/259
6,312,306 B1 * 11/2001 Kroll ..... 446/233
6,419,544 B1 * 7/2002 Parker et al. ..... 446/233

* cited by examiner

*Primary Examiner*—Jacob K. Ackun
*Assistant Examiner*—Jamila Wiliams
(74) *Attorney, Agent, or Firm*—LaMorte & Associates

(57) ABSTRACT

A system comprising a rotating device and a finger supported charging assembly for powering the rotating device. The rotating device has a housing with a base upon which the housing spins. An electric motor is contained within the housing that causes the housing to spin when the motor is activated. The finger supported charging assembly includes two contacts that are coupled to opposite terminals of a battery pack. The contacts are worn on opposing fingers and come into contact with the rotating device when the base of the rotation device is supported with the opposing fingers, when contacting the rotating device, the contacts on the opposing fingers provide electricity to the rotating device that powers the motor within the rotating device.

11 Claims, 3 Drawing Sheets

ELECTRIC TOY TOP DEVICE WITH FINGER SUPPORTED CHARGER AND ITS ASSOCIATED METHOD OF OPERATION

RELATED APPLICATIONS

This application is a Continuation-In-Part of co-pending application Ser. No. 10/243,813 now U.S. Pat. No. 6,685,531, entitled Electric Toy Top Device with Support And Its Associated Method of operation, filed Sep. 16, 2002.

BACKGROUND OF THE INVENTION

1. Field of the Invention

Generally, the present invention relates to toy tops, gyroscopes and other rotating novelty devices. More particularly, the present invention relates to rotating novelty devices that contain internal electric motors that are periodically powered by a separate electric source that is remote to the rotating novelty device.

2. Description of the Prior Art

Tops, gyroscopes and other freely rotating devices share certain common functional features. Tops, gyroscopes and other rotating devices have a central axis around which they spin. The center of gravity associated with the rotating device passes through that central axis and the mass of the rotating device is evenly distributed around the central axis. As the top, gyroscope or similar device is put into motion, the device spins about its central axis. Since the mass of the rotating device is evenly distributed around the central axis, the device spins in a uniform manner, thereby enabling the device to be balanced at a point in line with the central axis. The device will spin in a stable manner until the rotational speed of the device falls below a certain threshold level. As the speed of the device decreases, its angular momentum decreases. Eventually, the presence of angular momentum is insufficient to overcome the forces of gravity and the rotating device tips over.

Tops, gyroscopes and other rotating novelty devices have been in existence for generations. During that period of time, there have been many variations in design of the rotating novelty devices. In their simplest form, rotating novelty devices, such as tops and gyroscopes, are either directly manually spun or manually spun using a pull cord that is wound around the rotating novelty device. Such manual means to provide rotational energy are inexpensive, however the rotational energy provided is relatively small. Consequently, the top or gyroscope would only rotate for a short period of time before they tip over.

The longer a top, gyroscope or other freely rotating device spins, the more play value it generally has. Consequently, in the prior art, attempts have been made to create tops, gyroscopes and other freely rotating devices that spin for extended periods of time. One popular method of creating a device that spins for a prolonged period of time is to place a motor within the structure of the device. The motor spins a weight, thereby producing the angular momentum needed to maintain a spinning motion for as long as the motor is powered.

In the prior art, such devices are typically created by placing an electric motor in the center of the top or other freely rotating device. Batteries are then symmetrically placed around the electric motor so as to be balanced around the center of rotation. The batteries typically serve as the majority of the weight that is spun. As a result, the batteries both provide power to the electric motor and add significantly to the angular momentum of the device. Such prior art devices are exemplified by U.S. Pat. No. 3,628,285, to Murakami, entitled Gyroscopic Top Device.

A problem associated with prior art tops and gyroscopes that contain internal motors and batteries is that great care must be taken in the manufacturing tolerances in order to maintain the proper balance. This raises the cost associated with manufacturing such devices. Furthermore, since the spinning object contains both an electric motor and batteries, the device is rather heavy. Such devices, therefore, have a tendency to become damaged if the commonplace happens and the device falls to the floor after spinning off a table edge or falls out of a child's hand.

A need therefore exists for an improved type of drive system for a spinning top, gyroscope or other freely rotating device that provides rotational energy to the device, yet does not require that batteries be contained within the rotating device. This need is met by the present invention as described and claimed below.

SUMMARY OF THE INVENTION

The present invention is a system comprising a rotating device and a finger supported charging assembly for powering the rotating device. The rotating device has a housing with a base upon which the housing spins. An electric motor is contained within the housing that causes the housing to spin when the motor is activated. The finger supported charging assembly includes two contacts that are coupled to opposite terminals of a battery pack. The contacts are worn on opposing fingers and come into contact with the rotating device when the base of the rotation device is supported with the opposing fingers. When contacting the rotating device, the contacts on the opposing fingers provide electricity to the rotating device that powers the motor within the rotating device. Furthermore, a magnet can be present on one or both of the finger contacts that creates a magnetic field and reinforces the magnetic field created by the motor in the rotating device. This causes the motor in the rotating device to spin faster than it would outside the effects of that magnetic field. The magnets in the finger contacts can also be used to lift the rotating device as it spins.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the rotating device of the present invention system can be configured in many shapes and styles, such as a gyroscope or freely rotating toy, the rotating device of the present invention system is particularly well suited as a top. Accordingly, the illustrated example of the rotating device of the present invention system will be configured as a top in order to set forth the best mode contemplated for the invention. However, the choice of embodying the rotating device as a top should not be considered a limitation of the possible embodiments of the rotating device.

Figure 1:
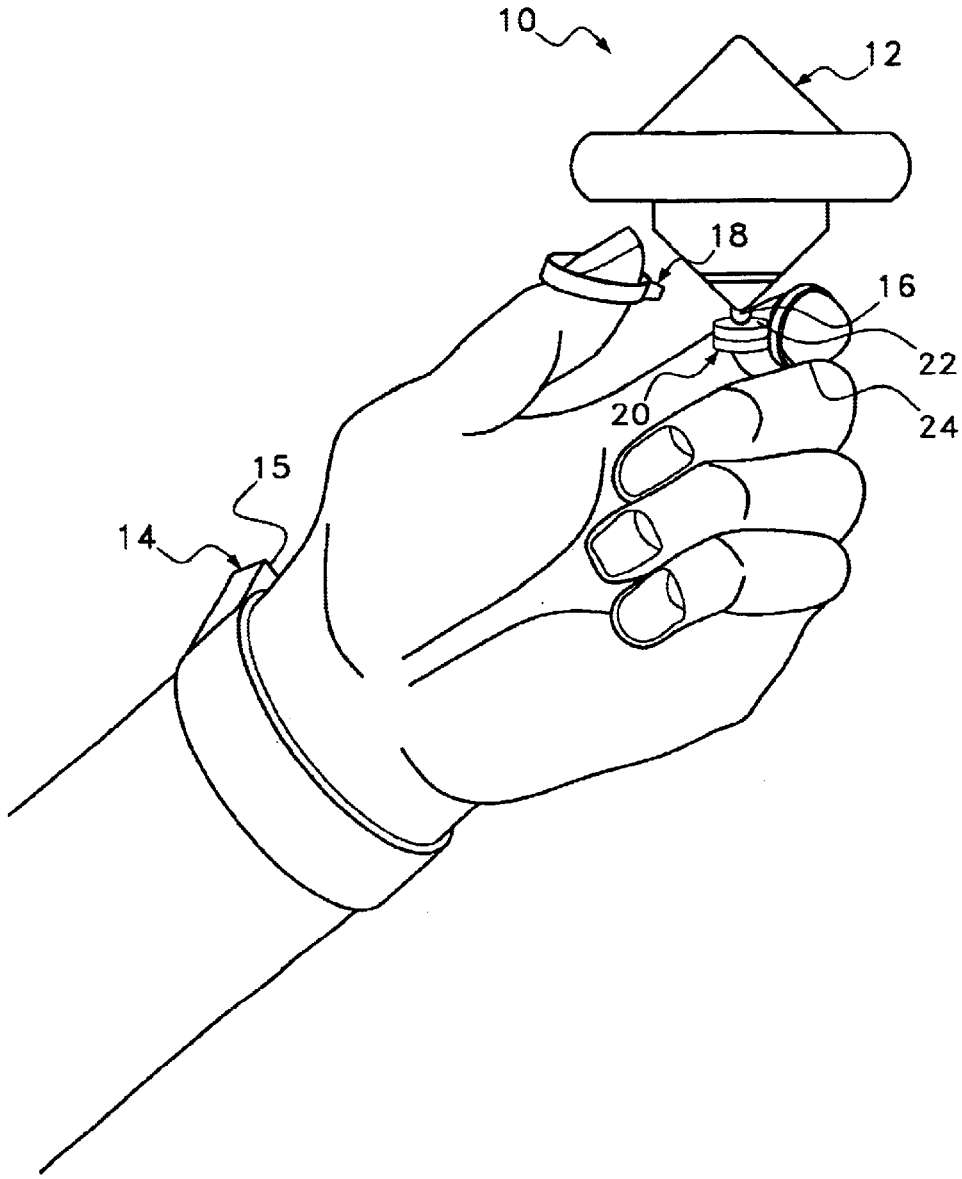
FIG. 1 is a perspective view of an exemplary embodiment of a system in accordance with the present invention.

Referring to FIG. 1, a toy top system 10 is shown. The toy top system 10 is comprised of a top 12 and a charging assembly 14 for the top 12. The top 12 has a balance point 16 upon which it rests as it spins.

The charging assembly 14 is worn on the hand. The charging assembly 14 consists of a battery pack 15 and two finger supported charging contacts 18, 20 that are coupled to opposite terminals of the battery pack 15. In the shown embodiment, the two finger supported charging contacts 18, 20 are shown being attached to the thumb and the index finger, respectively. The charging contact 20 worn on the index finger is configured to include a small support platform 22 that extends from the index finger. The support platform 22 supplies a surface upon which the balance point 16 of the toy top 12 can spin. The opposite charging contact 18 is supported by the thumb. As such, by closing the thumb and index finger together, the charging contact 18 on the thumb can be can be made to touch the toy top 12 as the toy top 12 spins on the support platform 22 of the opposite charging contact 20.

Both the charging contacts 18, 20 are connected to the battery pack 15. The battery pack 15 is worn either on the wrist or on the back of the hand. Flexible wires or ribbon cable connects the battery pack 15 to both finger supported charging contacts 18, 20.

As will be explained, the top 12 contains an internal electric motor. The internal electric motor causes the top 12 to spin. The internal electric motor is powered only when the balance point 16 of the top 12 is supported by the support platform 22 and the thumb charging contact 18 is brought into abutment with a specific region of the spinning top 12. As a result, when the balance point 16 of the top 12 passes onto the support platform 22, and the thumb charging contact 18 touches the proper region of the spinning top 12, the internal electric motor is powered by the battery pack 15 and the rotational velocity of the top 12 increases. Once up to its maximum speed, the top 12 can again be released from the fingers.

The movement of the top 12 is not limited to the confines of the support platform 22. Rather, the top 12 can be flipped out of the support platform 22 onto any smooth surface. AS the top 12 eventually slows, the support platform 22 on the index finger charging contact 20 can be used to scoop up the spinning top 12. The top 12 can then be contacted by the thumb charging contact 18, where it will again increase to its maximum rotational speed.

The index finger charging contact 20 contains a magnet 24 disposed below the support platform 22. The magnet 24, by being located below the support platform 22, creates a magnetic field that extends above the support platform 22 and effects the top 12 when it is spinning on the support platform 22. The magnetic field created by the magnet 24 reinforces the magnetic field created by the electric motor spinning within the top 12. The result is that the electric motor in the top 12 will spin more rapid than if the magnet 24 were not present.

Figure 2:
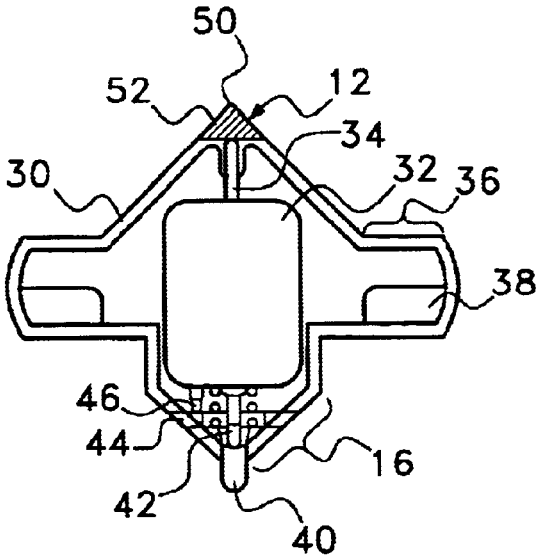
FIG. 2 is a selective cross-sectional view of the components of the system shown in FIG. 1.
Figure 2:
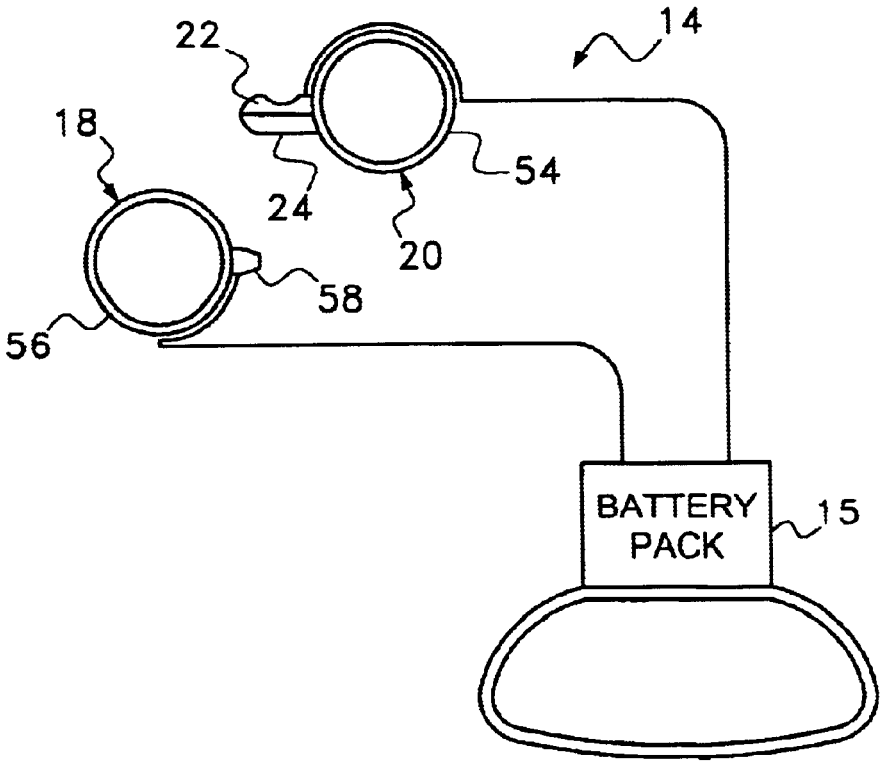

Referring to FIG. 2, it can be seen that the top 12 is comprised of a housing 30 that defines a central chamber. Within the central chamber is a free floating electric motor 32. Only the output shaft 34 of the electric motor 32 is rigidly connected to the housing 30. Accordingly, the electric motor 32 can remain stationary as its output shaft 34 rotates the top's housing 30 around the motor 32.

The housing 30 has an outer ring section 36. Within the outer ring section 36 is a weighted flywheel 38. The flywheel 38 adds to the mass of the top 12 and provides the angular momentum needed to keep the top 12 stable as the top 12 spins.

The bottom of the top's housing 30 forms the balance point 16 of the top 12. At the apex of the balance point 16 is a conductive point contact 40 that is coupled to a first lead 42 of the electric motor 32. Slightly farther up from the apex is a conductive ring contact 44. The ring contact 44 leads to a wiping contact 46 that interconnects the ring contact 44 to a second lead of the electric motor 32.

At the apex 50 of the top's housing 30 is positioned either a magnet or a mass of ferro-magnetic material 52. Accordingly, the apex 50 of the top's housing 30 will attract to an external magnet.

The finger supported charging contacts 18, 20 are also an assembly of various components. The index finger charging contact 20 contains a ring structure 54 that can be worn around the index finger. The support platform 22 is connected to the ring structure 54. On the support platform 22 is a depression. The material in the depression is conductive. The point contact 40 at the bottom of the toy top 12 therefore contacts the conductive material in the depression as the top 12 spins on the support platform 22. The conductive depression on the support platform 22 is wired to one of the terminals of the battery pack 15. Consequently, the conductive depression enables electricity to flow into the conductive point 40 of the top 12 when the top 12 is spinning on the support platform 22.

The thumb charging contact 18 is connected to a separate ring structure 56. The thumb charging contact 18 contains a conductive strip of material 58 that is coupled to the opposite terminal of the battery pack 15. When brought into contact with the side of the toy top 12, the conductive strip of material 58 touches the ring contact 44 on the top 12. The conductive strip of material 58 is wired to the battery pack 15 that is supported by the hand. Consequently, the thumb charging contact 18 transfers electricity to the ring contact 44 in the top 12 when these surfaces abut.

It will therefore be understood, that as the top 12 is held on the support platform 22 and is contacted with the thumb charging contact 18, the two contacts 40, 44 on the top 12 are connected to opposite terminals of the battery pack 15. The contacts 40, 44 in the top 12 lead to the electric motor 32. As a result, when the top 12 is held between the fingers wearing the charging assembly 14, the electric motor 32 is powered and the top 12 will spin under the power of the electric motor 32.

The magnet 24 is positioned under the support platform 22 on the index finger charging contact 20. When the electric motor 32 in the top 12 spins, it creates a magnetic field. Furthermore, the magnet 24 also creates a magnetic field. When the magnet 24 is present under the top 12, the magnetic fields interact. The result is that the motor 32 spins significantly faster than it would if the magnet 24 were not present. Depending upon the strength of the magnet 24 used and the composition of the electric motor 32, the rotational speed imparted to the top 12 by the electric motor 32 can be increased by nearly 100% due to the presence of the magnet 24.

Figure 3:
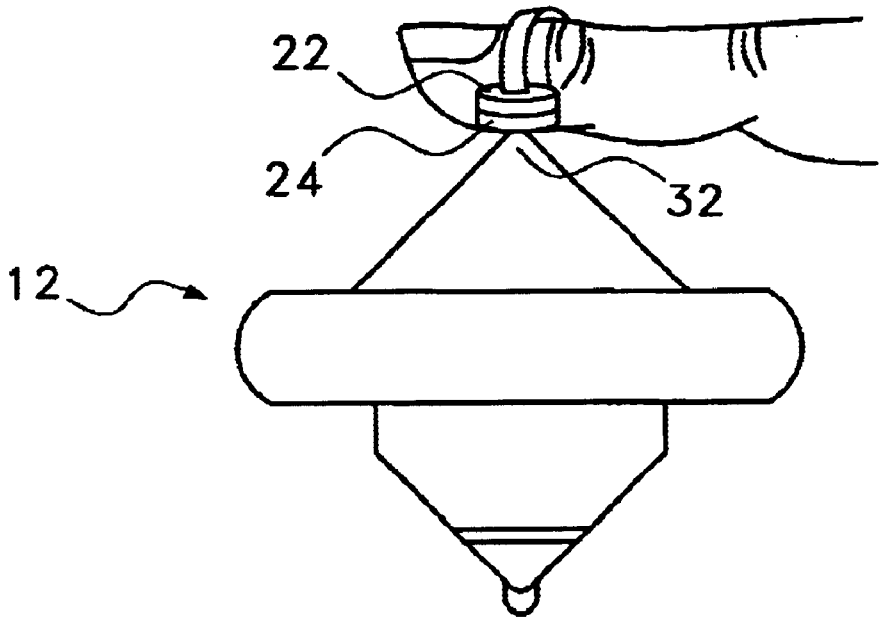
FIG. 3 is a side view of the present invention system where a magnet is being used to lift the rotating device as it spins.

From FIG. 2, it can be seen that the top apex 50 of the toy top 12 can contain another magnet or a mass of ferro-magnetic material 52. Referring now to FIG. 3, it will be understood, that if the magnet 24 under the support platform 22 is brought into contact with the apex 50 of the toy top 12, the apex of the toy top 12 will magnetically attach to the magnet 24. The magnetic attraction between the magnet 24 and the apex of the toy top 12 is preferably large enough to support the weight of the toy top 12 as it is spinning. AS such, the support platform 22 can support the toy top 12 from its bottom balance point or from its top apex.

It will be understood that the embodiment of the present invention system that is described and illustrated herein is merely exemplary and a person skilled in the art can make many variations to the embodiment shown without departing from the scope of the present invention. All such variations, modifications and alternate embodiments are intended to be included within the scope of the present invention. As defined by the appended claims.

What is claimed is:

1. A system, comprising:

a rotating assembly having a bottom point upon which said assembly can rotate;

an electric motor disposed within said assembly, wherein said electric motor rotates said rotating assembly upon said point when said electric motor is activated;

a charging assembly supported by a user's hand, said charging assembly containing a first contact, a second contact and a battery source coupled to said first contact and said second contact, wherein said first contact is coupled to a first ring that enables said first contact to be worn about a first finger, and wherein said battery source powers said electric motor in said rotating assembly when said rotating assembly is held in the user's hand and is brought into contact with said first contact and said second contact.

2. The system according to claim 1, wherein said second contact is coupled to a second ring that enables said second contact to be worn about a second finger.

3. The system according to claim 1, wherein said first contact includes a support platform on which said rotating assembly can spin.

4. The system according to claim 1, further including a magnet disposed proximate said support platform.

5. A method of activating an electric toy top; comprising the steps of:

providing a toy top containing an electric motor, wherein said electric motor is connect to contact points on an exterior of said toy top;

providing a battery source having two terminals;

providing two charging contacts that are coupled to said terminals of said battery source;

bringing said charging contacts into contact with said contact points on said exterior of said toy top while said toy top is spinning, thereby causing said battery source to activate said electric motor.

6. The method according to claim 5, further including the step of attaching said charging contacts to different fingers on a user's hand.

7. The method according to claim 5, further including the step of providing a magnet proximate at least one of said charging contacts.

8. A system, comprising:

a rotating assembly having a bottom point upon which said assembly can rotate;

an electric motor disposed within said assembly, wherein said electric motor rotates said rotating assembly upon said point when said electric motor is activated;

a charging assembly supported by a user's hand, said charging assembly containing a support platform on which said rotating assembly can spin, a first contact disposed on said support platform, a second contact and a battery source coupled to said first contact and said second contact, wherein said battery source powers said electric motor in said rotating assembly when said rotating assembly is held in the user's hand and is brought into contact with said first contact and said second contact whereby said rotating assembly spins on said support platform when powered by said battery source.

9. The system according to claim 8, wherein said first contact is coupled to a first ring that enables said first contact to be worn about a first finger.

10. The system according to claim 9, wherein said second contact is coupled to a second ring that enables said second contact to be worn about a second finger.

11. The system according to claim 8, further including a magnet disposed proximate said support platform.

* * * * *